United States Patent [19]

Turkia

[11] 4,381,217

[45] Apr. 26, 1983

[54] METHOD OF INCREASING THE TEMPERATURE OF SHOWER WATER USED IN A WOOD GRINDING PROCESS

[75] Inventor: Erkki Turkia, Inkeroinen, Finland

[73] Assignee: Oy. Tampella AB, Tampere, Finland

[21] Appl. No.: 317,637

[22] Filed: Nov. 2, 1981

[30] Foreign Application Priority Data

Nov. 18, 1980 [FI] Finland ..... 803601

[51] Int. Cl.[3] ..... D21B 1/24

[52] U.S. Cl. ..... 162/23; 241/18; 241/28

[58] Field of Search ..... 162/23; 241/18, 21, 241/28

[56] References Cited

U.S. PATENT DOCUMENTS

| | | | |
|---|---|---|---|
| 1,619,004 | 3/1927 | Sternkopf | 241/28 |
| 2,050,749 | 8/1936 | De Mers | 241/28 |
| 4,270,703 | 6/1981 | Haikkala | 241/18 |

*Primary Examiner*—William F. Smith
*Attorney, Agent, or Firm*—Ladas & Parry

[57] ABSTRACT

A method of increasing the temperature of shower water used in a wood grinding process wherein wood is ground in a grinding space (3) under a pressure exceeding atmospheric pressure, and warm shower water (G) is fed into the grinding space for improving the grinding process. In order to compensate losses of shower water replacement water (E) is added to the shower water circulating system. The replacement water is fed into the groundwood pulp (A) after the grinding space but before a steam separator. Thus cooler replacement water can be heated by the heat energy otherwise released from the groundwood pulp in the steam separator, and the temperature of the shower water can be maintained close to 100° C. in spite of the addition of cool replacement water and without using a pressurized steam separator.

1 Claim, 1 Drawing Figure

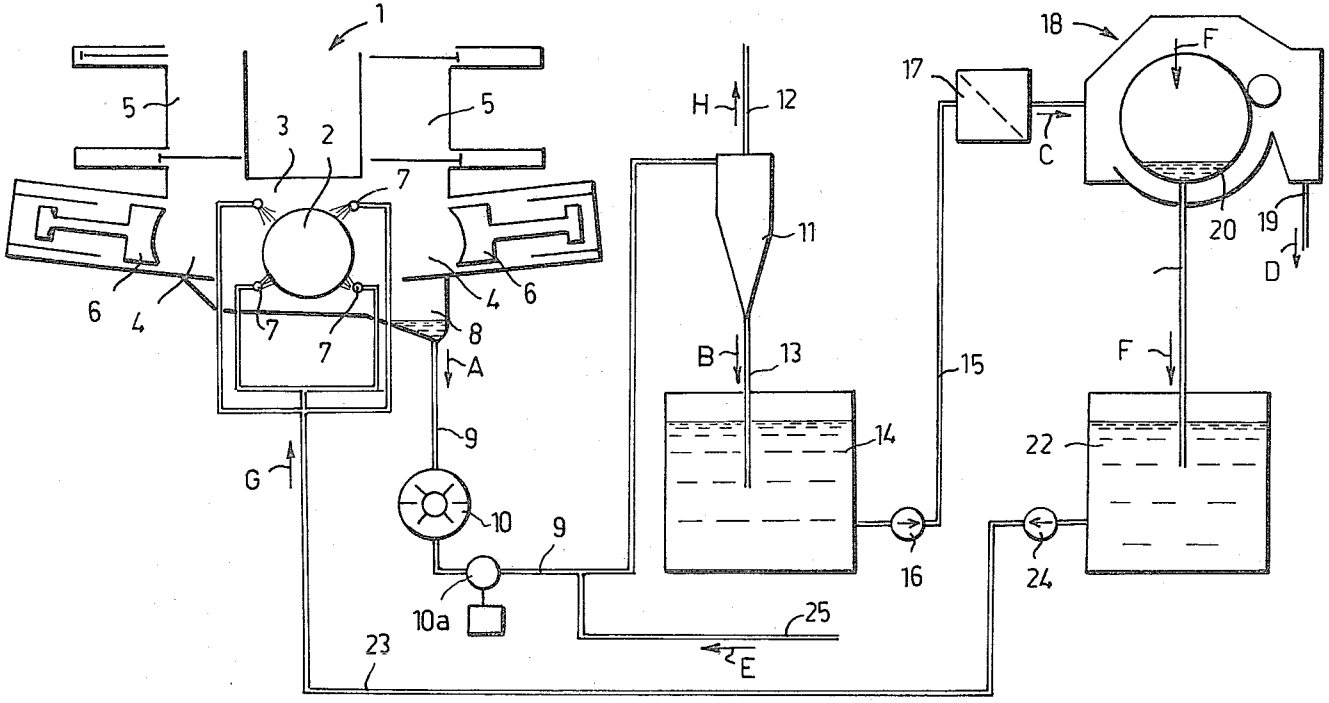
1
2
3
4
5
6
7
8
9
10
10a
11
12
13
14
15
16
17
18
19
20
22
23
24
25
A
B
C
D
E
F
G
H

METHOD OF INCREASING THE TEMPERATURE OF SHOWER WATER USED IN A WOOD GRINDING PROCESS

This invention relates to a method of increasing the temperature of shower water used in a wood grinding process, according to which wood is ground by a rotating grinding member in a grinding space under a pressure exceeding atmospheric pressure, warm shower water is sprayed into the grinding space, groundwood pulp is conveyed from the grinding space into a steam separator wherein the heat energy of the groundwood pulp is released as steam, the groundwood pulp is conveyed from the steam separator into a thickener from which the released water is fed into the grinding space as shower water, additional water is added to the shower water to compensate losses of shower water.

Pressurized grinding is earlier known (Finnish patent application Nos. 782414, 780514 and 780515, Swedish patent application No. 7411949-6 and Swedish Pat. Nos. 318178 and 336952) in which wood is ground in a grinding space under a pressure exceeding atmospheric pressure. Wood is fed into the pressurized grinding space for example by means of pressure equalizing chambers mounted above the grinding pockets of the grinder. The grinding space, defined by gates and a pulp pit, is pressurized preferably with air or steam. The defibration takes place by pressing wood blocks by a hydraulic piston against the grinding stone. The vibration caused by the grinding stone, the heat caused by friction and the shower water sprayed on the grinding stone separate the fibers from the wood material.

It has been found that in pressurized grinding the temperature of the shower water has a greater influence on the defibration than under atmospheric pressure. The warmer the shower water is, the longer and more unbroken are the fibers separated from the wood material, and the stronger is the paper made of such fibers. Thus it is the better for the pressurized grinding, the warmer the shower water is when returned to the grinder.

After the defibration the groundwood pulp flows out from the grinding space through a pipe in which sticks and bigger slabs of wood are cut into pieces by a stick crusher before adjusting the flow rate. The temperature of the pulp discharged from the grinding space is normally more than 100° C. In practice the pulp temperature may rise up to 145° C., depending on the temperature of the shower water and on the pressure of the grinding space. Thereby the temperature of the shower water when sprayed into the grinding space must be 130°–135° C. and the pressure in the grinding space 3 bar. The heat energy contained in the pulp suspension is released in the form of steam in a steam separator within which the pressure is decreased to atmospheric pressure, because the pulp temperature after the steam separator must be below the boiling point of water. From the steam separator the pulp can flow directly into a thickener where the hot shower water is separated from the pulp and is returned to the grinding space. From the steam separator the pulp can also be discharged into a tank from which it can be pumped to different kinds of screening such as pressurized screening and hydro cleaning before the pulp enters into a thickener where the hot shower water is separated from the pulp. From the thickener the pulp is discharged with a consistency of 5–33%.

Together with the pulp discharged from the thickener the system looses 2–20% of the warm shower meter. This loss as well as other possible losses must be compensated by addition of water, the temperature of which is often considerably lower, usually 50°–60° C. This additional water is added to a shower water tank following the thickener, and because of its low temperature it decreases the total temperature of the shower water fed to the grinding space 2°10° C. which is to be regarded as a disadvantage.

If the temperature of the additional water is for example 50° C. and its share of the total shower water is 6.7%, the temperature of the water removed from the groundwood pulp discharged from the steam separator is 99° C. When additional water is added to the shower water tank according to the known method, the temperature of the shower water pumped into the grinding space is only $$0.067 \cdot 50^\circ\ C. + 0.933 \cdot 99^\circ\ C. = 95.7^\circ\ C.$$

From Swedish patent application No. 7801814 a method for production of groundwood pulp is known according to which the groundwood pulp is fed from a grinder to a steam separator in which the overpressure of the pulp is decreased to atmospheric pressure before the pulp is fed to a thickener. The steam released from the steam separator is used for heating the additional water fed to the process for compensating the losses of shower water. Because the temperature of the steam released from the steam separator does not exceed 100° C. it is not possible to raise the temperature of the shower water over 100° C. Also a heat exchanger is needed for heating the additional water, which increases the cost of equipment.

The object of this invention is to provide a method of eliminating the above-mentioned disadvantages and making it possible to raise the temperature of the required replacement water economically close to 100° C. by utilizing the heat generated in the grinding process and without any pressurized steam separator. This object is achieved by a method according to the invention which is characterized in that the additional water for the shower water is fed to the groundwood pulp after the grinding space but before the steam separator.

The invention is based on the principle that when cooler water is mixed with the groundwood pulp having a temperature above 100° C. before the steam separator, the water is heated to the temperature of the mixture of the groundwood pulp and the water. The volume of generated steam is decreased due to the decreased temperature of the groundwood pulp suspension entering the steam separator. Also now the temperature of the groundwood pulp discharged from the steam separator corresponds to the evaporation temperature of the pressure of the steam separator. The temperature of the groundwood pulp discharged from the pressurized steam separator is about 100° C.

Because no water is added between the steam separator and the grinding space the temperature of the shower water fed into the grinding space stays very close to the temperature of the groundwood pulp discharged from the steam separator. The temperature decreases only because of possible temperature losses through pipes, tanks and other equipment. By the method according to the invention a temperature of about 99° C. is obtained for the shower water.

The invention will be described in more detail in the following with reference to the accompanying drawing which illustrates schematically a pressure grinding process according to the invention.

The drawing illustrates a grinding machine 1 comprising a rotating grinding stone 2 provided in a pressurized grinding space 3. The grinding space comprises two grinding pockets 4 above which two pressure equalizing chambers 5 known per se are provided which are closed by closing gates. On two opposite sides of the grinding stone there are hydraulic pistons 6 for pressing blocks of wood dropped into the grinding pockets against the grinding stone. In the grinding space there is a number of shower pipes 7 for supplying warm shower water on the surface of the grinding stone. For collecting the groundwood pulp a pulp pit 8 is provided in the grinding space.

From the pulp pit of the grinder leads a pipe 9 for the suspension A through a stick crusher 10 and a blow valve 10*a* to a steam separator 11 which is provided with an outlet pipe 12 for the steam H released from the pulp. From the steam separator leads a pipe 13 for feeding the groundwood pulp, relieved of steam, to a tank 14. From the tank leads a pipe 15 through a pump 16 and a pressure screen 17 to a thickener 18 for the groundwood pulp C to be thickened. The thickener is provided with an outlet 19 for the thickened groundwood pulp D.

The thickener is provided with a pit 20 for water F removed from the groundwood pulp C to be thickened. From the tank leads a pipe 21 to another tank 22. From this tank leads a pipe 23 through a pump 24 to shower pipes 7 provided in the grinding space, for feeding warm shower water G to said shower pipes.

When groundwood pulp is ground shower water circulates continuously through the circulating system formed by the pipes 9-13-15-21-23. A part of the shower water is discharged together with the thickened groundwood pulp, and due to other losses of water from the process, exhausting steam etc., more water must be added to the circulating system than the amount which escapes from the thickener with the pulp. The required replacement water E is fed to the pipe 9 which leads from the pulp pit 8 of the grinding space to the steam separator 11. The system receives no further replacement water after the steam separator and thus the temperature of the shower water fed into the grinding space remains nearly the same as the temperature of the groundwood pulp discharged from the steam separator, which temperature is about 100° C. when an atmospheric steam separator is being used.

The object of the drawing and the description is only to illustrate the principle of the invention. In its details the method according to the invention may vary within the scope of the claim.

What I claim is:

1. In a method of increasing the temperature of shower water used in a wood grinding process, grinding wood by a rotating grinding member (2) in a grinding space (3) under a pressure exceeding atmospheric pressure, spraying warm shower water (G) into the grinding space, conveying groundwood pulp (A) from the grinding sapce through a groundwood pit (8) and a pipe (9) into a steam separator (11) wherein the heat energy of the ground wood pulp is released as steam (H), and adding replacement water (E) to compensate for losses of shower water, the improvement comprising conveying the groundwood pulp from the steam separator into a thickener (18) from which the released water is fed back into the grinding space (3) as shower water and feeding said replacement water (E) having a temperature lower than the temperature of said shower water to the groundwood pulp (A) at a point in said pipe (9) located after said groundwood pit (8) but before the steam separator (11).

* * * * *